United States Patent [19]

Borden et al.

[11] Patent Number: 4,995,822

[45] Date of Patent: Feb. 26, 1991

[54] ELECTRICAL CONNECTOR

[75] Inventors: Thomas E. Borden, San Francisco, Calif.; Charles R. Nestor, Niles, Ohio; David W. Solano, Troy, Mich.

[73] Assignee: Raychem Corporation, Menlo Park, Calif.

[21] Appl. No.: 471,161

[22] Filed: Jan. 26, 1990

[51] Int. Cl.[5] ..... H01R 13/24

[52] U.S. Cl. ..... 439/161; 439/932

[58] Field of Search ..... 439/161, 932

[56] References Cited

U.S. PATENT DOCUMENTS

| | | | |
|---|---|---|---|
| 4,462,651 | 7/1984 | McGaffigan | 439/932 |
| 4,621,882 | 11/1986 | Krumme | 439/161 |
| 4,781,605 | 11/1988 | Herubel et al. | 439/161 |
| 4,787,854 | 11/1988 | Le Parquier | 439/161 |
| 4,810,201 | 3/1989 | de Mendez et al. | 439/161 |
| 4,881,908 | 11/1989 | Perry et al. | 439/161 |

*Primary Examiner*—Paula A. Bradley

*Attorney, Agent, or Firm*—Herbert G. Burkard

[57] ABSTRACT

A shock and vibration resistant electrical connector for making an electrical connection between at least two contacts, comprising a driver assembly which comprises a driver (preferably of heat-recoverable metal) which is capable of shrinking radially inwardly and of exerting a radially inward force, the assembly having two internal surfaces of insulating material which face one another and which are forced towards one another when the driver shrinks; and electrical contacts on the surfaces.

10 Claims, 2 Drawing Sheets

ELECTRICAL CONNECTOR

This invention relates to an electrical connector, for making an electrical connection between at least two contacts.

The subject matter disclosed in any document referred to below is incorporated in this specification by the reference to the document.

A feature of electrical connectors, which can be important for some applications, is that the force which maintains the contacts in contact with one another be relatively high. This can be important, for example, when the connector is subject to vibration or mechanical shock, or to widely varying temperatures leading to differential thermal expansion, which can cause the contacts to separate, leading to opening of the electrical circuit and possibly also to arcing. In the case of many connectors, a high contact force is obtained by resilient deformation of the contacts, which allows the contacts to move relative to one another, but ensures that they remain in contact with one another.

For some applications, it can be desirable that there is a fluid tight seal and no relative movement between the contacts of an electrical connector, for example when the contacts encounter a material when the connector is in use which causes the material of the contacts to corrode. Resilient deformation of the contacts should then preferably be avoided.

The present invention provides an electrical connector for making an electrical connection between at least two contacts, comprising:

(a) a driver assembly which comprises a driver which is capable of shrinking radially inwardly and of exerting a radially inward force, the assembly having two internal surfaces of insulating material which face one another and which are forced towards one another when the driver shrinks; and (b) electrical contacts on the surfaces.

Preferably, the force which is exerted on the contacts by the driver is greater than the force which would be required to deform the contacts resiliently, and can therefore substantially eliminate relative movement between the contacts as a result of mechanical shock or vibration, or of variations in temperature which lead to differential thermal expansion. More preferably, the force exerted on the contacts by the driver can lead to plastic deformation of the contacts, which can ensure that there is a gas-tight seal between them. This allows the connector to be used in environments in which the contacts are exposed to materials which would otherwise lead to corrosion of the material of the contacts, on exposure as a result of relative movement of the contacts. Furthermore, the use of an inwardly shrinkable driver allows tolerances between the contacts to be taken up.

The driver will be formed from a material which allows it to shrink radially inwardly, and to exert a radially inward force. It may be formed from a material which can be deformed elastically such as a beryllium-copper alloy, or from a spring steel.

Preferably, the driver is heat-shrinkable. A heat-shrinkable article is one which can be made to shrink appreciably when subjected to heat. Usually such articles shrink towards an original shape from which they have previously been deformed, but they can also adopt a new configuration without having previously been deformed.

An advantage of the use of a heat-shrinkable driver is that the force which is required to eliminate relative movement between the contacts can be exerted conveniently without complicated mechanical manipulation. Furthermore, the force can be exerted by a component which is relatively small, and light in weight.

Yet further, the connector can be arranged so that the force required to position the contacts relative to one another for connection can be low, or even zero.

Heat-shrinkable articles made from polymeric material are disclosed in U.S. Pat. Nos. 2,027,962, 3,086,242 and 3,597,372. As is made clear in U.S. Pat. No. 2,027,962, the original dimensionally heat-stable form of such a sleeve may be a transient form in a continuous process in which, for example, an extruded tube is expanded while still hot to a dimensionally heat-unstable form but, in other applications, a preformed dimensionally heat-unstable form may exist in a separate stage prior to its expansion.

Preferred polymeric materials are disclosed in EP-A-Nos. 153199 and 157640, which are polyethylenes having a high molecular weight, especially greater than 150,000 or more preferably greater than 3 million. The use of such materials in the connector of the present invention has the advantage that high forces can be exerted when they recover, as can sometimes be necessary when a high contact force is required.

It is particularly preferred that the driver be formed from a shape memory alloy. Shape memory alloys exhibit a shape memory effect as a result of their ability to transform between martensitic and austenitic phases. The transformation may be caused by a change in temperature: for example, a shape memory alloy in the martensitic phase will begin to transform to the austenitic phase when its temperature increases to a temperature greater than $A_s$, and the transformation will be complete when the temperature is greater than $A_f$. The reverse transformation will begin when the temperature of the alloy decreased to a temperature less than $M_s$ and will be complete when the temperature is less than $M_f$. The temperature $M_s$, $M_f$, $A_s$ and $A_f$ define the thermal transformation hysteresis loop of a shape memory alloy. An article may be formed in a desired configuration while in its austenitic phase. If it is then cooled so that it transforms to the martensitic phase, it can then be deformed so as to obtain a strain on recovery of up to about 8%. The strain imparted to the article is recovered when the article is subsequently heated so that it transforms back to the austenitic phase. Further information is available is available in the article by L. M. Schetky in Scientific American, Volume 241, pages 68 to 76 (1979) entitled Shape Memory Alloys.

The use of a shape memory alloy in the connector of the present invention has the advantage that high forces can be exerted when they recover. Furthermore, a high force can be obtained from a driver which occupies a relatively small amount of space, which can be a particular advantage when the amount of available space is limited. Yet further, the force which is exerted by the driver after it has been installed can be substantially constant over a long period of time.

The alloy will generally be a nickel-titanium based alloy, which may include additional elements for example to modify its transformation temperatures or its strength characteristics. For example, the alloy may be a binary alloy consisting essentially of nickel and titanium, for example 50.8 atomic percent nickel and 49.2 atomic percent titanium, or it may contain a quantity of a third element such as copper, iron or niobium. Ternary nickel-titanium based shape memory alloys are disclosed in U.S. Pat. Nos. 3,753,700, 4,337,090, 4,565,589 and 4,770,725. Copper or iron based alloys may also be used, for example alloys consisting essentially of copper, aluminum and nickel, copper, aluminum and zinc, copper and zinc, or iron, manganese and silicon. Copper based alloys are disclosed in U.S. Pat. No. 4,144,104, 4,146,392 and 4,166,739.

Preferably, the driver assembly includes at least one packing member which can be positioned in the direction of recovery of the driver, and which provides the surfaces of insulating material on which the electrical contacts are provided. The use of one or more packing members allows a driver to be used whose shape is not governed by the configuration of the surfaces on which contacts are provided. For example a driver may be used which is elliptical in cross-section and is radially shrinkable, and inserts in the form of packing members may be used to apply the force exerted by the driver to two contacts, the force being approximately unidirectional. For example, two packing members may be provided, each of which is approximately semi-elliptical or more preferably semi-circular in cross-section, and provides a planar surface on which the electrical contact is provided.

More preferably, the driver assembly includes more than two packing members, and contacts are provided on each surface of each packing member which faces another packing member. For example, one of the packing members may be a circuit board or a flexible film, having contacts on one or both of its two principal surfaces. The board or film may be positioned between two packing pieces having surfaces facing the circuit board which surfaces have contacts on them for connection with respective contacts on the circuit board. Alternatively, the board or film may have contacts on one of its principal surfaces, and be wrapped around a packing member which has contacts on its external surface.

When the driver is formed from a shape memory alloy, it is preferred that the packing members when present are formed from insulating material. Instead of discrete packing members (or in addition thereto), the driver may be provided with a coating of an insulating material, for example by plating.

It is preferred that the insulating material that is provided on the surfaces of the driver assembly is sufficiently strong that the contacts are deformed more than the insulating material when the driver shrinks.

Particularly preferred insulating materials include ceramic materials based on steatite or on alumina, and engineering polymers such as certain poly aryl ether ketones.

It is preferred that the driver is substantially elliptical in cross-section, so that on shrinkage it exerts stress somewhat uniformly on contacts positioned in the direction of its shrinkage. More preferably, the driver is substantially circular in cross-section, for ease of manufacture, and, in some embodiments, to ensure that the force exerted by it is uniform around the perimeter of the packing member(s).

Preferably, the internal surfaces of the driver assembly on which the contacts are provided are essentially planar, and they are moved towards one another when the driver recovers.

The driver may have a non-continuous cross-section. For example, it may be C-shaped or formed as a helically wound element. This is particularly well suited to drivers that are formed from a shape memory alloy, and it allows such drivers to change their transverse dimension on shrinking by more than the amount that is normally possible with a driver which has a continuous cross-section, for example in the form of a hoop. Furthermore, the force which is required to install such a driver can be less than that which is required to install a circumferentially continuous driver.

The contacts may be fixed onto the relevant surfaces of the packing assembly. This may be the case, for example, when the contacts are provided on the surfaces of a printed circuit board, for example as conductive traces. Contacts may be provided located loosely with respect to their respective surfaces: for example a surface may be profiled such that each contact can be located positively on it. For example, one or more of the contacts may be provided by an insulated conductor from which a portion of the insulation has been removed, and the surface on which such a contact is provided may have a closed ended groove on it in which the contact can be received.

The invention also provides an electrical circuit which comprises two conductors which are electrically connected to one another by means of the connector of the invention.

The connector of the invention is particularly well suited for use in applications in which harsh conditions are encountered, for example, mechanical shock or vibration, or exposure to materials which can cause corrosion of the materials of the contacts. Examples of such uses include applications in which the connector is located in the vicinity of fuel combustion and is therefore exposed to high temperatures, and possibly also to vibration, for example in the engine compartment of a vehicle. For example, the connector could be used in a gas sensor for monitoring exhaust gases emitted from the combustion chamber of an internal combustion engine.

Embodiments of the present invention will now be described by way of example with reference to the accompanying drawings, in which.

Figure 1:
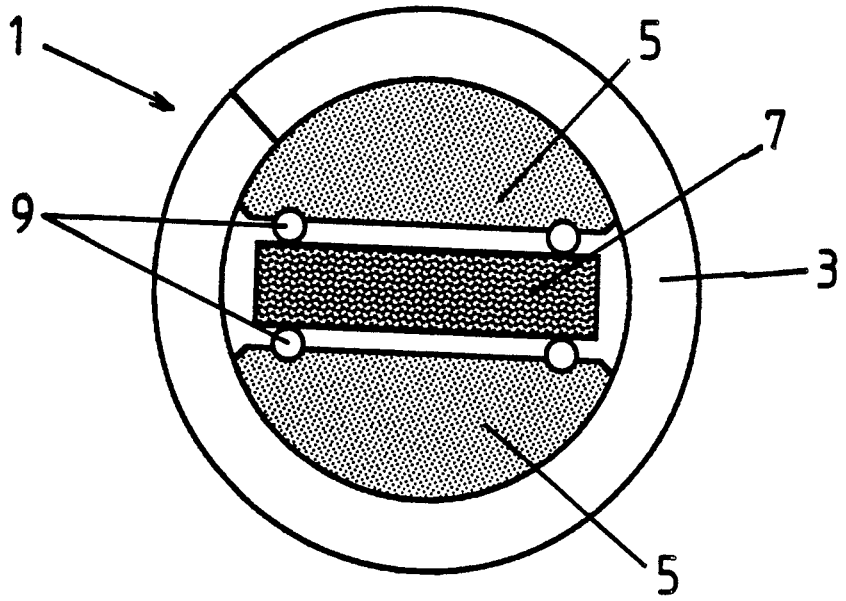
FIG. 1 is an end elevation of an electrical connector.
Figure 2:
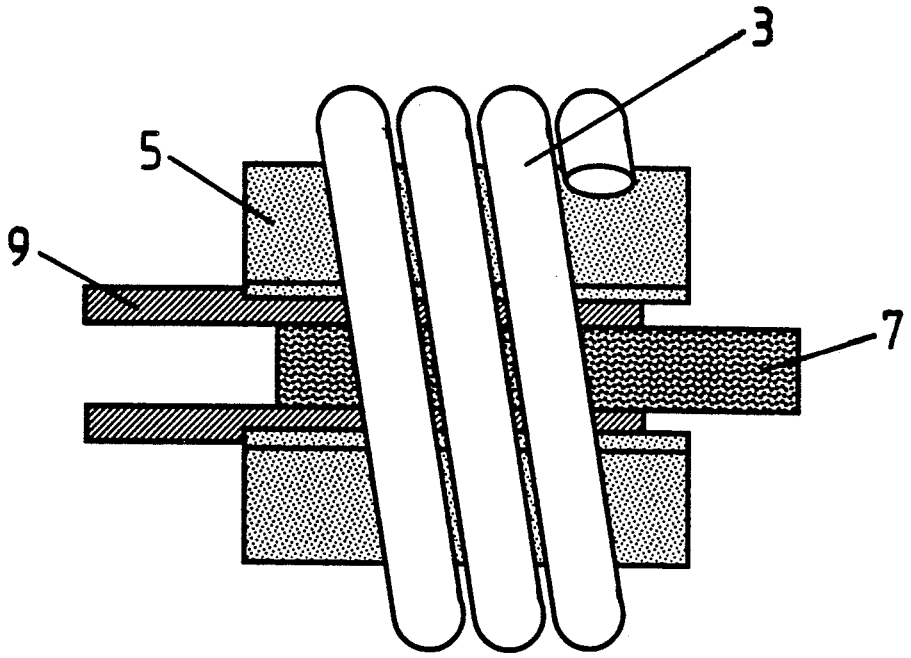
FIG. 2 is side elevation of the electrical connector shown in FIG. 1.

Referring to the drawings, FIGS. 1 and 2 show a connector comprising a driver assembly 1 which comprises a radially heatshrinkable driver 3 provided by a helically extending wire of a nickel titanium based shape memory alloy, and a plurality of packing members 5, 7. Two of the packing members 5 are approximately semi-circular in cross-section and are formed of an insulating ceramic material. The third packing member 7 is a circuit board which bears two contacts on each of its principal surfaces, and associated circuitry. The conductors 9 of two insulated electrical wires are positioned against the planar surface of each of the semi-circular packing members 5, between the semi-circular packing members and the circuit board 7, and such that when the packing members and the circuit board are forced towards one another, the conductors 9 and the contacts on the circuit board contact one another. Preferably, the strands of the conductors 9 are consolidated. The cross-section of the assembled packing members 5, 7 and conductors 9 is approximately circular, as is the cross-section of the driver 3.

Figure 3:
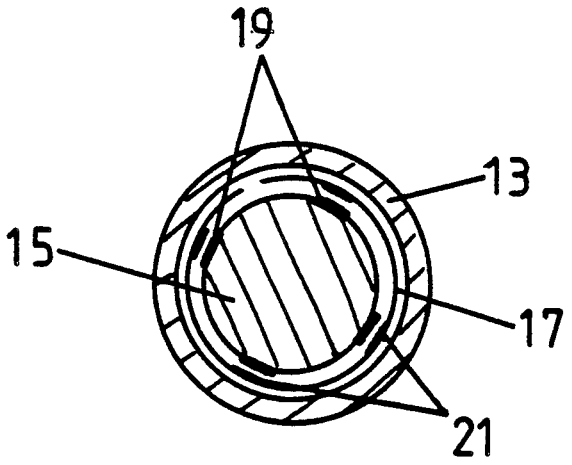
FIG. 3 is an end view of another embodiment of connector, in cross-section.

FIG. 3 shows a connector which comprises a driver assembly which comprises a cylindrical radially heat-shrinkable driver 13 of a nickel titanium based shape memory alloy, and two packing members 15, 17. One of the packing members 15 is cylindrical and has contacts 19 on its outer surface. The other of the members 17 is provided by a flexible film which has contacts 21 on one of its principal surfaces. The film 17 is wrapped around the cylindrical object 15, so that the contacts on the film and the cylindrical object are aligned. The film and the cylindrical object are then positioned inside the driver, that is in the direction in which it shrinks when heated, and the driver is then heated to cause it to shrink and to force the contacts on the film 17 towards the contacts on the cylindrical object 15.

What is claimed is:

1. An electrical connector for making an electrical connection between at least two contacts, comprising:

(a) a driver assembly which comprises a driver which is capable of shrinking radially inwardly and of exerting a radially inward force, the assembly having two internal surfaces of insulating material which face one another and which are forced towards one another when the driver shrinks said insulating material being plated onto the internal surfaces of the driver; and (b) electrical contacts on the inner surface of the insulating material.

2. An electrical circuit which comprises two conductors which are electrically connected to one another by means of a connector as claimed in claim 1.

3. An electrical connector in accordance with claim 1 comprising:

(a) a driver element comprising a helically wound, heat recoverable metal driver so configured as to shrink radially inwardly;

(b) at least two insulating packing members positioned within the driver element such that opposing surfaces on the two members are forced towards one another when the driver recovers; and (c) electrical contacts on opposing surfaces of the packing members.

4. A connector in accordance with claim 3 wherein the opposing surfaces of the packing members are substantially planar.

5. A connector in accordance with claim 3 in which at least one of said contacts comprises an insulated conductor from which at least a portion of the insulation has been removed.

6. A connector in accordance with claim 3 in which said heat recoverable metal driver comprises a nickel titanium alloy.

7. A connector in accordance with claim 3 in which the driver element when shrinking exerts a force sufficient to plastically deforming said contacts.

8. A connector in accordance with claim 3 in which said packing members deform to a lesser extent than said contacts.

9. A connector in accordance with claim 3 in which said packing members are ceramic.

10. A connector in accordance with claim 3 in which said packing members are substantially circular in configuration following shrinkage of said driver element.

* * * * *